US010561888B2

(12) United States Patent
Chen

(10) Patent No.: US 10,561,888 B2
(45) Date of Patent: Feb. 18, 2020

(54) PLANK ASSIST DEVICE

(71) Applicant: Albert Chen, Jersey City, NJ (US)

(72) Inventor: Albert Chen, Jersey City, NJ (US)

( * ) Notice: Subject to any disclaimer, the term of this patent is extended or adjusted under 35 U.S.C. 154(b) by 105 days.

(21) Appl. No.: 15/923,653

(22) Filed: Mar. 16, 2018

(65) Prior Publication Data

US 2019/0282850 A1 Sep. 19, 2019

(51) Int. Cl.
*A63B 21/00* (2006.01)
*A63B 21/002* (2006.01)

(52) U.S. Cl.
CPC ..... *A63B 21/4035* (2015.10); *A63B 21/0023* (2013.01); *A63B 21/4019* (2015.10)

(58) Field of Classification Search
CPC ..... A63B 21/4035; A63B 21/4039; A63B 23/1236; A63B 23/16; A61F 5/37; A61F 5/0118; A61F 5/05866; B24D 15/02–023
See application file for complete search history.

(56) References Cited

U.S. PATENT DOCUMENTS 5,121,743 A * 6/1992 Bishop ..... A61F 5/05866 128/879
6,093,159 A * 7/2000 Racoosin ..... A61H 15/0092 15/92
7,156,791 B2 1/2007 Edwards
7,318,794 B2 1/2008 Davies
8,220,076 B2 7/2012 Chen
2006/0089241 A1* 4/2006 Klein ..... A63B 21/00047 482/141
2007/0055191 A1* 3/2007 Farrell ..... A61F 5/05866 602/21
2007/0238578 A1 10/2007 Landfair
2012/0214653 A1 8/2012 Tsou
2013/0029815 A1 1/2013 Lu
2015/0366277 A1 12/2015 Rabbeth
2017/0319897 A1 11/2017 Lane
2017/0368408 A1 12/2017 Wojcik

* cited by examiner

*Primary Examiner* — Jennifer Robertson
(74) *Attorney, Agent, or Firm* — Albert B. Chen

(57) ABSTRACT

A plank assist device is presented comprising a base and a strap. The base has a first portion for supporting a human palm and a second portion for supporting a portion of a human thumb. The first portion comprises a first portion top surface, a first portion bottom surface, a first portion rear end and a first portion front end. The second portion comprises a second portion top surface, a second portion bottom surface, a second portion rear end and a second portion front end. The second portion is shorter in length and narrower in width than the first portion. In addition, the first portion rear end may be higher in height than the first portion front end, and the second portion rear end may be higher in height than the second portion front end.

19 Claims, 5 Drawing Sheets

PLANK ASSIST DEVICE

FIELD OF THE INVENTION

The invention relates to a plank assist device. More specifically, the invention relates to a plank assist device that may be useful for reducing wrist pain during planks.

BACKGROUND

There are numerous exercises which are known to help build strength in the arms, shoulders, glutes, back, core and various other parts of the body. One such popular exercise is the plank.

A plank is a static or stationary exercise in which the trainee (i.e., a person who is doing the exercise) maintains a position similar to a push-up position for a length of time. There are many variations of the plank, of which one of the most common is where the trainee maintains his or her position at the top of a push-up position for a length of time. By maintaining this position, this exercise is known to work many different muscles, including but not limited to the abdominals, arms, shoulders, glutes, back, etc.

However, one potential issue with the plank that many trainees experience is wrist pain.

In a normal wrist alignment, a trainee's wrist is aligned in a straight line with the rest of the arm. However, in certain plank positions, a trainee's wrist is aligned at an angle to the rest of the arm. Usually, this angle is approximately 90 degrees or approximately perpendicular to the rest of the arm, but can be more or less than 90 degrees depending the trainee's position.

In plank positions where the trainee's wrist is aligned at an angle to the rest of the arm, there is downward pressure being exerted on the trainee's wrist due to the weight of the body being supported by the wrist. A combination of this downward pressure being supported by the wrist while aligned at an angle to the rest of the arm often leads to wrist pain after a certain length of time in these plank positions.

To try and help alleviate wrist pain during planks, a trainee can wear wrist straps that wrap around the wrist to provide additional support to the wrist. However, these wrist straps can be uncomfortable to wear and inconvenient to put on for a single plank exercise.

Alternatively, a trainee can use a prop such as yoga blocks to adjust the angle of the wrist during a plank position so that the wrist pain can be reduced. However, conventional yoga blocks are not optimally designed for just planks, and are further cumbersome and inconvenient to carry around for a single plank exercise.

As such, there is a need for a plank assist device designed solely to help reduce wrist pain during planks that is portable and easy to carry around.

SUMMARY

A new and novel plank assist device has been invented to overcome the limitations of conventional fitness accessories for reducing wrist pain during planks.

The plank assist device comprises a base and a strap. The base has a first portion for supporting a human palm and a second portion for supporting a portion of a human thumb. The first portion comprises a first portion top surface, a first portion bottom surface, a first portion rear end and a first portion front end. The second portion comprises a second portion top surface, a second portion bottom surface, a second portion rear end and a second portion front end. The second portion is both shorter in length and narrower in width than the first portion.

In an exemplary embodiment of the plank assist device of the present invention, the first portion rear end is higher in height than the first portion front end, and the second portion rear end is higher in height than the second portion front end.

DETAILED DESCRIPTION

Figure 1:
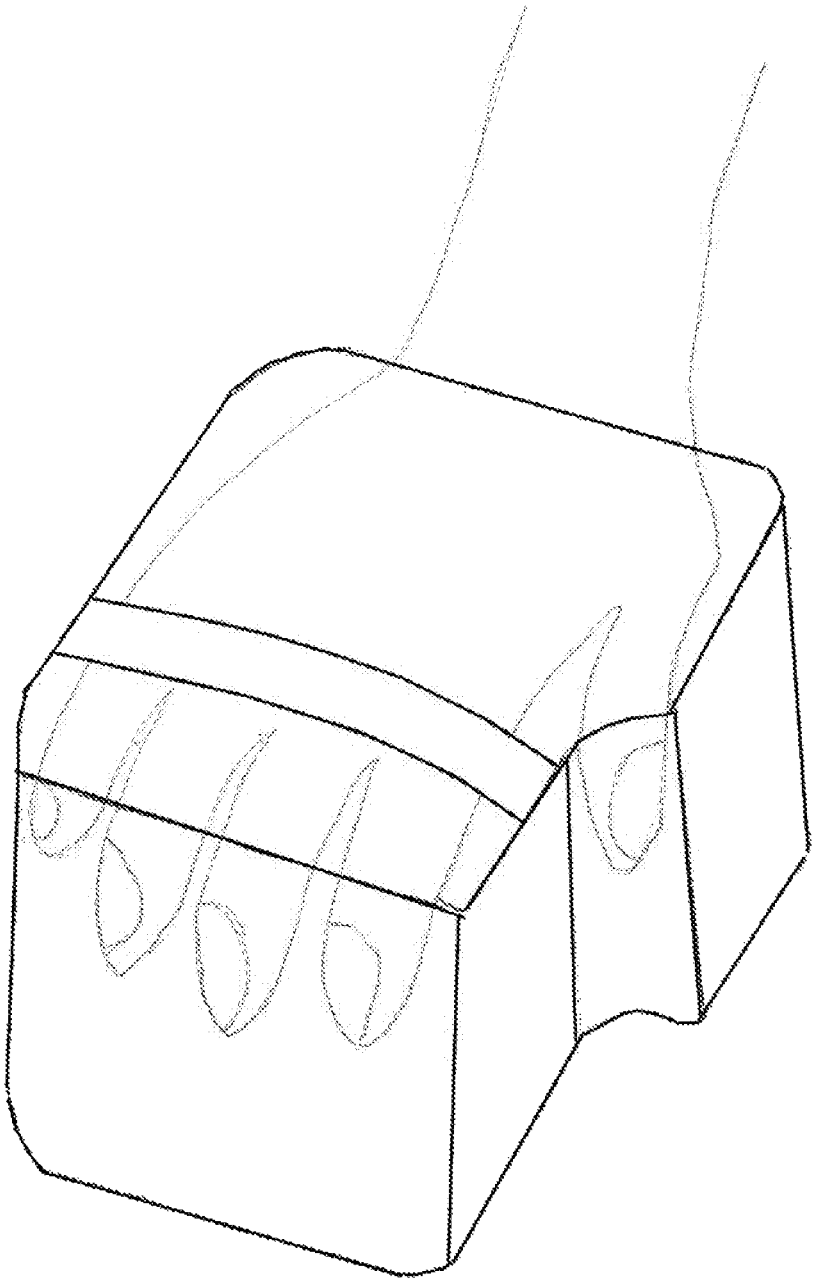
FIG. 1 is an illustration of the perspective view of an exemplary embodiment of the present invention shown in operation with a human hand.
Figure 2:
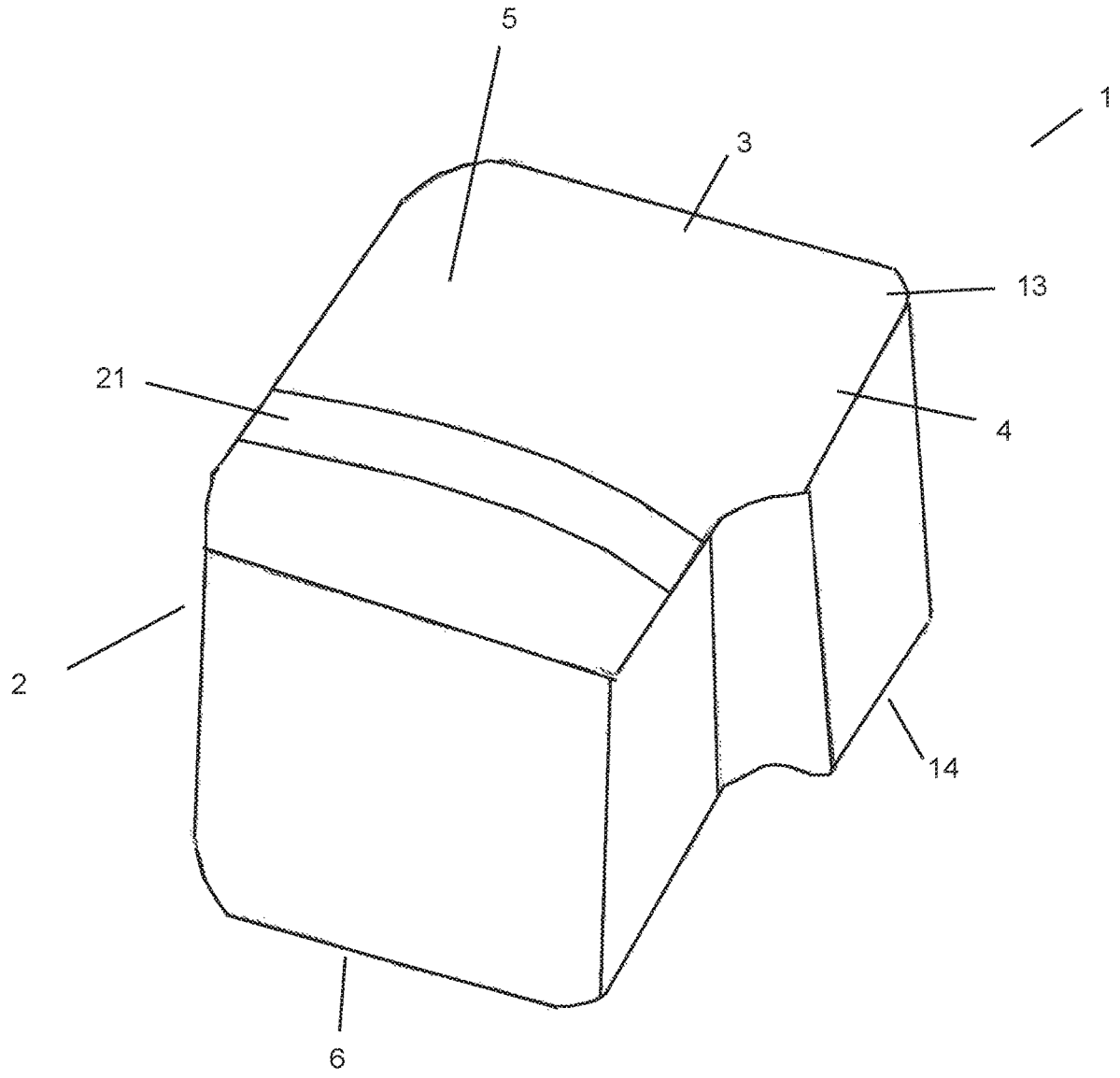
FIG. 2 is an illustration of the perspective view of an exemplary embodiment of the present invention.

As shown in FIGS. 1 and 2, the plank assist device 1 has a base 2 connected to a strap 21.

Figure 3:
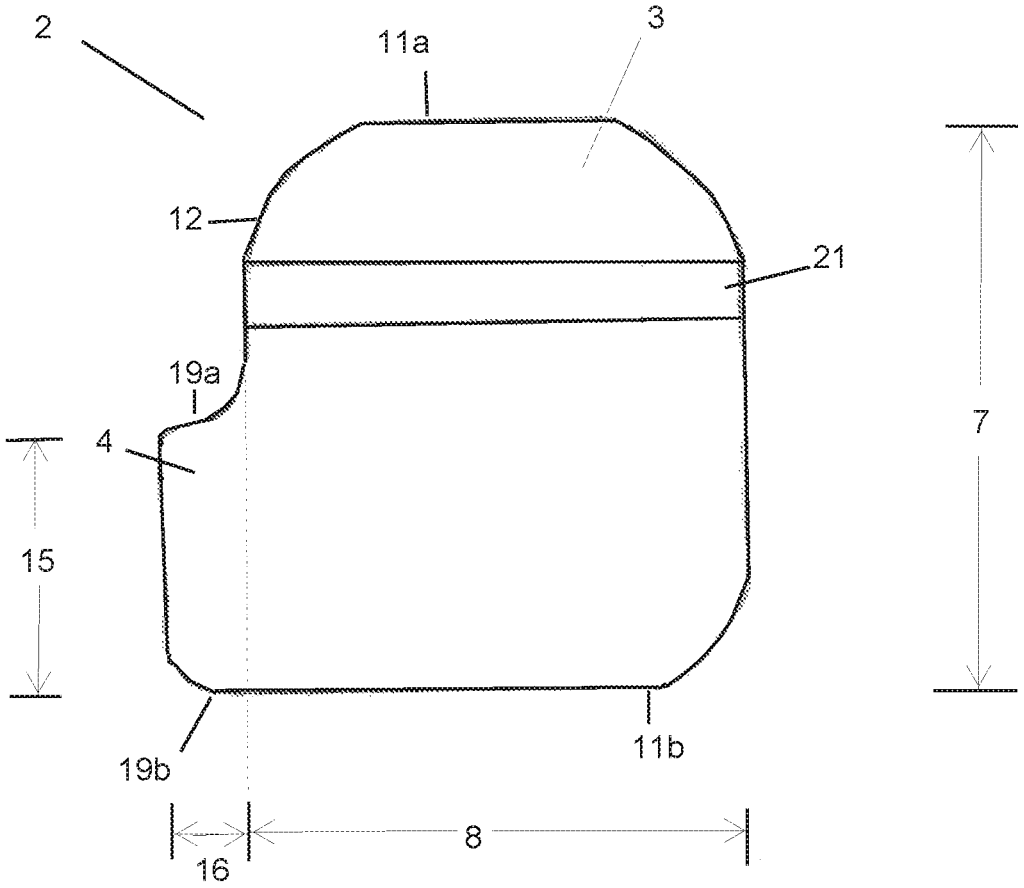
FIG. 3 is an illustration of the top view of an exemplary embodiment of the present invention.

As shown in FIG. 3, the base 2 comprises a first portion 3 and a second portion 4. The first portion 3 is designed to support the palm of the trainee's hand, meaning that the entire palm (i.e., the portion between the bases of the fingers and the wrist) of a trainee's hand will rest on the first portion 3 as opposed to just a part of the palm. The second portion 4 is shorter in length and narrower in width than the first portion 3, and is designed to support a portion of the thumb of a trainee's hand, meaning that only a portion of a trainee's thumb needs to be able to rest on the second portion 4 (as opposed to the entire thumb).

The base 2 may be formed from durable resilient material such as foam. The foam may be an open cell foam or a closed cell foam. Suitable foams may be formed from polyurethane, polyethylene, polystyrene, polybutadiene and copolymers thereof. Additional suitable foams can also be formed from ethylene vinyl acetate (i.e., ethylene vinyl acetate foam) or polyethylene vinyl acetate. Other suitable foams include high density and/or cross linked foams formed from any of the previously mentioned polymers, such as, for example high density cross linked polyethylene foam or high density ethylene vinyl acetate foam. High density foams (e.g., greater than 100 $kg/m^3$ such as 100-500 $kg/m^3$, 150-500 $kg/m^3$, 200-500 $kg/m^3$, 250-500 $kg/m^3$, 300-500 $kg/m^3$, 350-500 $kg/m^3$, 400-500 $kg/m^3$, 450-500 $kg/m^3$, etc.) such as high density ethylene vinyl acetate foams are preferred because they have a higher hardness (i.e., specified as durometer hardness, in accordance with Asker Hardness Tester, Type C (JIS C) of greater than 40 degrees such as 40-75 degrees, 45-75 degrees, 50-75 degrees, 55-75 degrees, 65-75 degrees, 70-75 degrees, etc.), and therefore are more able to support a trainee's weight without depressing or without changing its shape much as opposed to a low density or soft foam in which the foam will depress or change its shape more in response to the trainee's body weight (i.e., a low density foam with lower hardness will not help reduce wrist pain during planks due to a more uncomfortable angle of the wrist to the rest of the arm caused by the "sinking" of the wrist into the foam).

Natural or synthetic rubbers and polymers may be used as well to form the base 2. Other materials that may be useful for forming the base 2 also include wood, cork and silicone gel.

First Portion

The first portion 3 has a first portion top surface 5 for contacting with the palm of the trainee's hand. The first portion 3 also has a first portion bottom surface 6 for contacting with the floor.

The first portion 3 also has a first portion rear end 11*b* (i.e., the portion closer to the wrist) and a first portion front end 11*a* (i.e., the portion closer to the fingers and farther away from the wrist).

Figure 4:
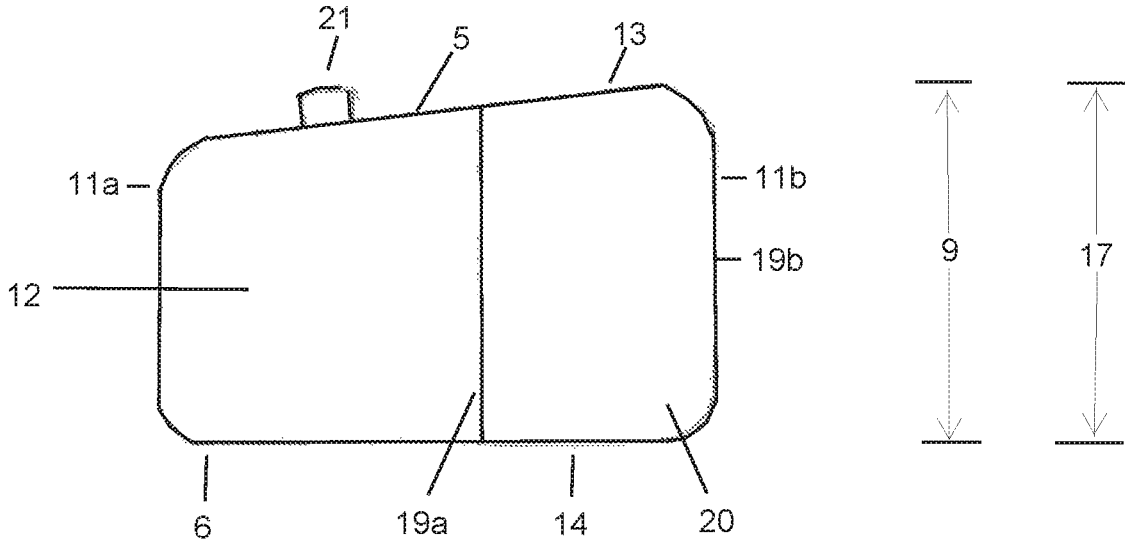
FIG. 4 is an illustration of a side view (from the thumb side) of an exemplary embodiment of the present invention.

The first portion top surface 5 can be flat (as shown for example in FIG. 5) or angled. If angled, the first portion rear end 11*b* is preferably higher (e.g., 1%, 2%, 3%, 4% or 5%) in height than the first portion front end 11*a* as shown for example, as shown in FIG. 4. In an exemplary embodiment, the first portion rear end 11*b* may be 1/16, 2/16, 3/16 or 4/16 of an inch or more higher in height than the first portion front end 11*a*. Alternatively, the first portion rear end 111*b* is lower (e.g., 1%, 2%, 3%, 4% or 5%) in height than the first portion front end 11*a* For example, the first portion rear end 11*b* may be 1/16, 2/16, 3/16 or 4/16 of an inch or more lower in height than the first portion front end 11*a*.

In addition, the first portion top surface 5 can also have a concave or convex shape. In a concave shape, the first portion edge 10 of the first portion top surface 5 is higher (e.g., 1%, 2%, 3%, 4% or 5%) in height than the center of the first portion top surface 5. For example, the first portion edge 10 may be 1/16, 2/16, 3/16 or 4/16 of an inch or more higher in height than the center of the first portion top surface 5. In a convex shape, the center of the first portion top surface 5 is higher (e.g., 1%, 2%, 3%, 4% or 5%) in height than the edge 10 of the first portion top surface 5. For example, the first portion edge 10 may be 1/16, 2/16, 3/16 or 4/16 of an inch or more lower in height than the center of the first top surface 5. Where the first portion top surface 5 is both angled and concave (or convex), the height of first portion edge 10 is represented by the highest height measurement of all of the edges of first portion top surface 5.

The first portion 3 can be further characterized as having a first portion length 7 (i.e., the longest length measurement in the first portion 3 irrespective of shape), a first portion width 8 (i.e., the widest measurement in the first portion 3 irrespective of shape) and a first portion height 9 (i.e., the highest height measurement in the first portion 3 irrespective of shape).

The first portion 3 may have a length 7 of 4.0, 4.5, 5.0, 5.5, 6.0, 6.5, 7.0, 7.5 inches or longer. To support the trainee's palm, the first portion length 7 will be longer than the length of the trainee's palm (i.e., the longest length measurement of the trainee's palm).

The first portion 3 may have a width 8 of 4.0, 4.5, 5.0, 5.5, 6.0, 6.5, 7.0, 7.5 inches or wider. To support the trainee's palm, the first portion width 8 will be wider than the width of the trainee's palm (i.e., the widest width measurement of the trainee's palm).

The first portion 3 may have a height 9 of 2.0, 2.5, 3.0, 3.5, 4.0 inches or higher. Preferably, the first portion height 9 is high enough so that when the trainee's palm is resting on the top surface 5, the trainee's fingers (or portions thereof) can rest over the edge 10 without touching the floor (even if only when bent). In this respect, the first portion height 9 may be higher than the length of the trainee's index finger. Alternatively, the first portion height 9 may be of a height that permits the end of the trainee's fingers to touch the floor.

The first portion height 9 may also be referred to as the thickness of first portion 3. As explained earlier, the first portion height 9 may vary depending whether the first portion top surface 5 is angled or not. The first portion height 9 may be represented by first portion sides 12 (i.e., the part in between the first portion top surface 5 and the first portion bottom surface 6).

The first portion edges 10 may be smooth, sharp, curved or angled. Preferably, the first portion edge 10 is beveled to improve grip.

The first portion front end 11*a* can have a curved shape. This curved shape may be partially oval or circular in nature, and designed to approximate the shape of the palm where the fingers begin to extend. In addition, the first portion front end 11*a* can also include individual grooves or extensions (e.g., bumps) for the placement of a trainee's four fingers.

The first portion rear end 11*b* can be straight, curved or tapered.

The first portion 3 can also be custom molded to fit the shape of the trainee's palm.

Second Portion

The second portion 4 is designed to support a trainee's thumb or a portion of a trainee's thumb.

The second portion 4 can unitary and made from the same piece as first portion 3, or can be a separate piece that is glued or attached to first portion 3 using any conventional means known in the art. If the entire base 2 is made from a single piece, an illustrative/imaginary dotted line shown in FIG. 3 separates the second portion 4 from the first portion 3 for purposes of describing the present invention. That is, as shown by an illustrative dotted line in FIG. 3, the second portion 4 begins at an imaginary line or plane of first portion 3 defined by the first portion side 12 closest to the placement of the trainee's index finger and extends laterally or horizontally away from first portion 3.

The second portion 4 is narrower in width and shorter in length than first portion 3. As will provided in more detail below, the second portion 4 may have a width that is 10-30% of the first portion 3 and a length that is 10-50% of the first portion 3. One skilled in the art would readily recognize that any other narrower ranges within these two ranges based on the various endpoints described below for the width and length are included as well (e.g., 10-15%, 10-20%, 10-25%, 15-20%, 15-25%, etc.).

The second portion 4 has a second portion top surface 13 for contacting with the thumb or a portion of the thumb of the trainee's hand. The second portion top surface 13 is preferably coplanar (i.e., shares the same plane as) the first portion top surface 5. The second portion 4 also has a second portion bottom surface 14 for contacting with the floor and thus is coplanar with first portion bottom surface 6.

The second portion 4 also has a second portion rear end 19*b* (i.e., the portion closer to the wrist) and a second portion front end 19*a* (i.e., the portion closer to the edge of thumb and farther away from the wrist).

The second portion top surface 13 can be flat (as shown for example in FIG. 5) or angled. If angled, the second portion rear end 19*b* is preferably higher (e.g., 1%, 2%, 3%, 4% or 5%) in height than the second portion front end 19*a* as shown for example in FIG. 4. Likewise, the second portion rear end 19*b* may be 1/16, 2/16, 3/16 or 4/16 of an inch or more higher in height than the second portion front end 19*a*. Alternatively, the second portion rear end 19*b* is lower (e.g., 1%, 2%, 3%, 4% or 5%) in height than the second portion front end 19*a*. For example, the second portion rear end 19*b* may be 1/16, 2/16, 3/16 or 4/16 of an inch or more lower in height than the second portion front end 19*a*.

The second portion 4 can be further characterized as having a second portion length 15 (i.e., the longest length measurement in the second portion 4 irrespective of shape), a second portion width 16 (i.e., the widest measurement in the second portion 4 irrespective of shape) and a second portion height 17 (i.e., the highest height measurement in the second portion 4 irrespective of shape).

The second portion 4 may have a length 15 of 1.0, 1.5, 2.0, 2.5, 3.0 inches or longer. However, the second portion length 15 is shorter than first portion length 7. To support a portion of a trainee's thumb, the second portion length 15 is longer than the portion of the trainee's thumb which rests on the second portion 4. The second portion length 15 may be 50%, 40%, 35%, 30%, 25%, 20%, 15% or 10% of the first portion length 7. Preferably, as shown for example in FIG. 3, the second portion rear end 19*b* lines up with first portion rear end 11*b* (i.e., collinear, in the same line as, etc.). Alternatively, the second portion rear end 19*b* can be slightly in front (e.g., 1/16, 2/16, 3/16, 4/16 inch or more) in front of first portion rear end 11*b*.

In addition to the various lengths of the second portion 4 discussed in the preceding paragraph, it is also preferred that the second portion front end 19*a* does not extend past the center of first portion top surface 5 (e.g., does not extend past 50% of first portion length 7 when measured from first rear end 11*b*). For example, the second portion front end 19*a* does not extend past 45%, 40%, 35%, 30%, 25% or 20% of first portion length 7 when the second portion rear end 19*b* is collinear with the first portion rear end 11*b*.

The second portion 4 may have a width 16 of 0.5, 1.0, 1.5, 2.0, inches or wider. However, the second portion width 16 is narrower than first portion width 8. To support a trainee's thumb, the second portion width 16 is wider that the trainee's thumb. The second portion length 15 may be 30%, 25%, 20%, 15% or 10% of the first portion width 8.

The second portion 4 may have a height 17 of 2.0, 2.5, 3.0, 3.5, 4.0 inch or higher. Preferably, the second portion height 17 is high enough so that when the trainee's thumb is resting on the second top surface 13, any part of the trainee's thumb that is resting over the second portion edge 18 will not touch the floor. In this respect, the second portion height 18 would be higher than the length of the trainee's thumb. Alternatively, the second portion height 18 may be less than the length of the trainee's thumb to permit the end of the trainee's thumb to touch the floor.

The second portion height 17 may also be referred to as the thickness of second portion 4, and may be the same or different from the first portion height 9.

Figure 5:
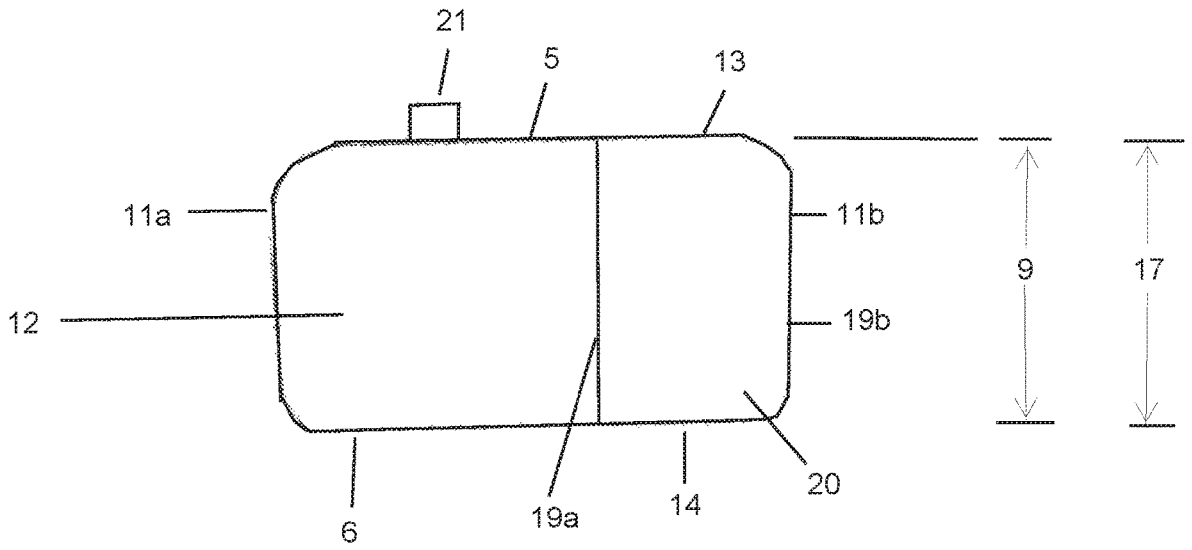
FIG. 5 is an illustration of a side view (from the thumb side) of an exemplary embodiment of the present invention.

In addition, as explained earlier, the second portion height 17 may vary depending whether the second portion top surface 13 is angled or not. The second portion height 17 may be represented by second portion sides 20 (i.e., the part in between the second portion top surface 13 and the second portion bottom surface 14). Preferably, where both the first portion top surface 5 and the second portion top surface 13 are angled and coplanar, the first portion rear end 11*b* and the second portion rear end 19*b* would have the same height as shown in FIGS. 4 and 5. Furthermore, the second portion front end 19*a* will also be at the same height as the immediately adjacent portion of the first portion top surface 5 as shown in FIGS. 4 and 5 when the second portion top surface 13 is coplanar with first portion top surface 5.

The second portion edge 18 may be smooth, sharp, curved or angled. Preferably, the second portion edge 18 is beveled to improve grip.

The second portion front end 19*a* can have a straight or curved shape. The second portion front end 19*a* can also include groove or an extension (e.g., bump) for the placement of a trainee's thumb.

Strap

The plank assist device 1 may also include a strap 21, which may be any strap conventionally known in the art. The strap 21 may be adjustable. The strap 21 can have a width of 1.0, 1.5, 2 inch or more (or less). Preferably, the strap 21 is a single strap or band. Alternatively, there may be multiple straps or bands present. The strap 21 may be attached to base 2 using any means known in the art.

The strap 21 is preferably attached first portion 3. For example, the strap 21 can be attached on one end to the first portion side 12 that is closest to the pinky finger and on the other side to the first portion side 12 that is closest to the index finger. Alternatively, the strap 21 can extend from first portion top surface 5 one end that is closest to the pinky finger and on the other end that is closest to the index finger.

Furthermore, the strap 21 can also be attached to first portion top surface 5 and/or first portion side 12 at multiple locations (as opposed to only two locations as discussed in the preceding paragraph), so as to form additional "holes" or "tunnels" for one or more fingers to pass under. For example, strap 21 can be attached on one end to the first portion side 12 that is closest to the pinky finger, on the other side to the first portion 12 that is closest to the index finger and in the middle to the first portion top surface 5, thereby creating two "holes" or "tunnels" for a trainee's fingers to pass under. One advantage in this configuration is that it creates a "pole" or "thread" by which the web of a trainee's finger abuts against so that a trainee's palm does not slip past the entire first portion top surface 5 (i.e., to better hold a trainee's palm in place).

In addition, the strap 21 is preferably located toward the front portion front end 11*a*. For example, the front edge (i.e., the edge closest to the front portion front end 11*a*) of strap 21 is located 1.0, 1.5, 2.0 or more inches away from the front portion front end 11*a*. Alternatively, the strap 21 is located at a position that is between 10-20%, 20-30% or 30-40% of the first portion length 7 away from the front portion front end 11*a*.

The strap 21 may be made of the same material as the base 2, or may be made of a different material such as rubber, textile, cotton, nylon, polyester or any other conventional material known in the art.

ALTERNATIVE EMBODIMENTS

Heretofore, Applicant's invention has been described using the transitional phrase "comprising." As will be readily apparent to one skilled in the art, Applicant's invention as described herein can also be defined with all of the same components as discussed above using the transitional phrase "consisting essentially of" in place of "comprising" to exclude any extra elements or components not described that materially affects the basic and novel characteristics of Applicant's invention such as additional portions or supports as part of base 2 other than the first portion 3 for supporting a palm and second portion 4 for supporting a portion of a thumb, as well as additional attachments other than the strap 21 extending from the first portion top surface 5 or the first portion sides 12.

For example, in another exemplary embodiment of the present invention, the plank assist device consists essentially of a base and a strap. The base has a first portion for supporting a human palm and a second portion for supporting a portion of a human thumb. The first portion comprises a first portion top surface, a first portion bottom surface, a first portion rear end and a first portion front end. The second portion comprises a second portion top surface, a second portion bottom surface, a second portion rear end and a second portion front end. The second portion is narrower in width and shorter in length than the first portion. Furthermore, in an exemplary embodiment of the plank assist device of the present invention, the first portion rear end is higher in height than the first portion front end, and the second portion rear end is higher in height than the second portion front end.

As will also be readily apparent to one skilled in the art, Applicant's invention as described herein can also be defined with all of the same components as discussed above using the transitional phrase "consisting of" in place of "comprising" to exclude any extra elements or components not recited in the claim.

In yet another exemplary embodiment of the present invention, the plank assist device consists of a base and a strap. The base has a first portion for supporting a human palm and a second portion for supporting a portion of a human thumb. The first portion comprises a first portion top surface, a first portion bottom surface, a first portion rear end and a first portion front end. The second portion comprises a second portion top surface, a second portion bottom surface, a second portion rear end and a second portion front end. The second portion is narrower in width and shorter in length than the first portion. Furthermore, in an exemplary embodiment of the plank assist device of the present invention, the first portion rear end is higher in height than the first portion front end, and the second portion rear end is higher in height than the second portion front end.

Having thus described the basic concept of the invention, it will be rather apparent to those skilled in the art that the foregoing detailed disclosure is intended to be presented by way of example only, and is not limiting. Various alterations, improvements, combinations and modifications will occur and are intended to those skilled in the art, though not expressly stated herein. These alterations, improvements, combinations and modifications are intended to be suggested hereby, and are within the spirit and scope of the invention.

The invention claimed is:

1. A plank assist device consisting essentially of:
a strap and
a base having
a first portion for supporting a human palm, said first portion comprising
a first horizontal portion top surface,
a first portion bottom surface,
a first portion rear end and
a first portion front end, and
a second portion for supporting a portion of a human thumb, said second portion comprising
a second horizontal portion top surface,
a second portion bottom surface,
a second portion rear end and
a second portion front end,
wherein said second portion is narrower in width and shorter in length than said first portion, and
wherein said strap is attached only to said first portion.

2. The plank assist device of claim 1, wherein
said second portion rear end is collinear with said first portion rear end, and
said second portion has a width that is 10-30% of said first portion and a length that is 10-50% of said first portion.

3. The plank assist device of claim 1, wherein
said second portion rear end is collinear with said first portion rear end, and
said second portion has a width that is 10-30% of said first portion and a length that is 10-40% of said first portion.

4. The plank assist device of claim 1, wherein said second portion top surface is coplanar with said first portion top surface.

5. The plank assist device of claim 1, wherein said first portion front end does not intersect with said second portion front end.

6. The plank assist device of claim 1, wherein said first portion has a first portion side which separates said first portion front end from said second portion front end.

7. The plank assist device of claim 1, wherein said strap is attached only to said first portion at a position between 10-20% of the length of said first portion away from said first portion front end.

8. The plank assist device of claim 1, wherein said strap is attached only to said first portion at a position between 20-30% of the length of said first portion away from said first portion front end.

9. The plank assist device of claim 1, wherein said strap is attached only to said first portion at a position between 30-40% of the length of said first portion away from said first portion front end.

10. The plank assist device of claim 1, wherein said strap is attached only to said first portion at a position between the first portion front end and the second portion front end.

11. A plank assist device consisting of:
a strap and
a base having
a first portion for supporting a human palm, said first portion comprising
a first horizontal portion top surface,
a first portion bottom surface,
a first portion rear end and
a first portion front end, and
a second portion for supporting a portion of a human thumb, said second portion comprising
a second horizontal portion top surface,
a second portion bottom surface,
a second portion rear end and
a second portion front end,
wherein said second portion is narrower in width and shorter in length than said first portion, and
wherein said strap is attached only to said first portion.

12. The plank assist device of claim 11, wherein
said second portion rear end is collinear with said first portion rear end, and
said second portion has a width that is 10-30% of said first portion and a length that is 10-50% of said first portion.

13. The plank assist device of claim 11, wherein
said second portion rear end is collinear with said first portion rear end, and
said second portion has a width that is 10-30% of said first portion and a length that is 10-40% of said first portion.

14. The plank assist device of claim 11, wherein said first portion front end does not intersect with said second portion front end.

15. The plank assist device of claim 11, wherein said first portion has a first portion side which separates said first portion front end from said second portion front end.

16. The plank assist device of claim 11, wherein said strap is attached only to said first portion at a position between 10-20% of the length of said first portion away from said first portion front end.

17. The plank assist device of claim 11, wherein said strap is attached only to said first portion at a position between 20-30% of the length of said first portion away from said first portion front end.

18. The plank assist device of claim 11, wherein said strap is attached only to said first portion at a position between 30-40% of the length of said first portion away from said first portion front end.

19. The plank assist device of claim 11, wherein said strap is attached only to said first portion at a position between the first portion front end and the second portion front end.

* * * * *